United States Patent [19]

Reid et al.

[11] 3,933,302

[45] Jan. 20, 1976

[54] CYLINDRICAL FIBER CONTAINER WITH DISPLAY LABEL

[75] Inventors: Francis R. Reid; James R. Leezer, both of Minneapolis, Minn.

[73] Assignee: The Pillsbury Company, Minneapolis, Minn.

[22] Filed: Mar. 4, 1975

[21] Appl. No.: 555,208

Related U.S. Application Data

[63] Continuation of Ser. No. 313,731, Dec. 11, 1972, abandoned.

[52] U.S. Cl. ..... 229/51 BP; 220/4.5; 426/128

[51] Int. Cl.[2] ..... B65D 81/34; B65D 83/00

[58] Field of Search ..... 224/51 BP, 3.5 R, 4.5, 224/93; 426/128

[56] References Cited

UNITED STATES PATENTS

| | | | |
|---|---|---|---|
| 2,793,126 | 5/1957 | Fienud et al. | 229/51 BP |
| 2,793,127 | 5/1957 | Geist et al. | 229/51 BP |
| 2,891,714 | 6/1959 | Vallas | 229/51 BP |
| 2,901,162 | 8/1959 | Vallas | 229/51 BP |
| 3,030,001 | 4/1962 | Stump | 229/51 BP |
| 3,174,676 | 3/1965 | Stump et al. | 229/51 BP |
| 3,366,493 | 1/1968 | Stump | 229/51 BP |

*Primary Examiner*—George E. Lowrance
*Assistant Examiner*—Bruce H. Bernstein
*Attorney, Agent, or Firm*—James V. Harmon; Michael D. Ellwein

[57] ABSTRACT

A fiber can is described which includes a body composed of a relatively thin liner and a much heavier sheet of body stock covered by a temporary reinforcing sheet or inner label which is enclosed within a display label that encircles the container to provide at least one spirally wound convolution so that the display label partially overlaps itself at least enough to cover the temporary reinforcing sheet and can be removed without disturbing the temporary reinforcing sheet. The container can be used for a variety of products such as fresh dough and other foods, juices, lubricating oils, etc. A circular cut or tear strip is provided to facilitate removal of the display label and in some cases the opening of the container.

10 Claims, 5 Drawing Figures

CYLINDRICAL FIBER CONTAINER WITH DISPLAY LABEL

This is a continuation of application Ser. No. 313,731, filed Dec. 11, 1972 now abandoned.

THE PRIOR ART

One major shortcoming of fiber cans now in use for shipping such products as orange juice, biscuits, lubricating oil and the like, is that a limited area of the label makes it impossible to provide a large visual display of the product and a description of how the product is to be used. The spiral wound labels now in use are composed of a single thickness of sheet material usually including an incidental overlap of material at the edges, e.g. 1/16 inch or ⅛ inch wide to prevent an unsightly gap at the edge of the label. For this reason, there is no opportunity to describe the product in detail or to provide attractive recipes together with pictures, in some cases to assist the user. Simply wrapping completed cans, for example by rolling them up in a large display sheet is expensive and requires additional manufacuring equipment. Another problem with present fiber cans of this kind is that the can is weakened when the label is removed.

THE OBJECTS

It is an object of the present invention to provide (a) a cylindrical fiber container having an inner body wall and an outer spirally wound display label of at least one convolution superimposed around the underlying material and provided with a removable, pealable portion detachable adhered to the inner body wall, (b) the provision of a method for forming a fiber can and simultaneously applying a display label having a surface area much larger than the external surface of the can itself, (c) provision for allowing the label to be reliably secured to the container but easily removed by the user without causing the can to be likely to pop open prematurely, (d) the provision of a container having a generally cylindrical body formed from an inner body wall having a separation line running the entire length of the container, a temporary reinforcement over the body wall to secure the body wall together at the separation line and an overlying label which is either about the same size or larger in size than the area of the external cylindrical wall of the container with a tab or other provision for removing the label without at the same time removing the temporary reinforcing means and a further provision for separately removing the reinforcing means when the container is to be opened, (e) provision for securely retaining the label to the underlying material during storage and shipment but permitting removal without leaving the can unreinforced.

SUMMARY OF THE INVENTION

Briefly, the present invention provides a cylindrical fiber container, a relatively heavy sheet of body stock covered by a temporary reinforcing means such as a sheet which is itself enclosed within a display label that encircles the container to provide at least one spirally wound convolution. In one form of the invention, the display label is at least about 1½ times the width of the body stock so that the display label partially overlaps itself. The container can be used for a variety of products such as foods, juices, lubricating oils, etc. In some cases, a circular cut or tear strip is provided to facilitate removal of the label in opening the container.

This invention makes possible the provision of a large size label by wrapping the label around the underlying material more than one convolution and by setting its width at one and one half times or for example, double the width of the body stock and possibly even wider. The label is removably secured to the underlying material. When the temporary reinforcing sheet is removed, the body of the container can be opened along the separation line in the body stock.

THE FIGURES

THE PREFERRED EMBODIMENTS

Figure 3:
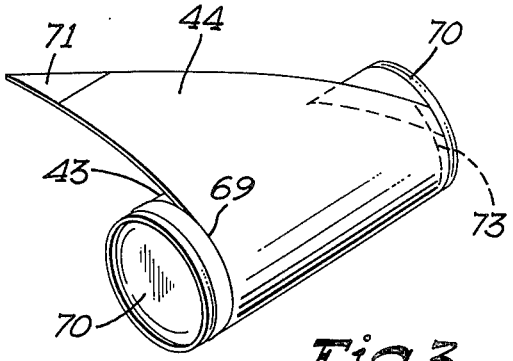
FIG. 3 is a view showing the first stage of removal of the label from the container.
Figure 5:
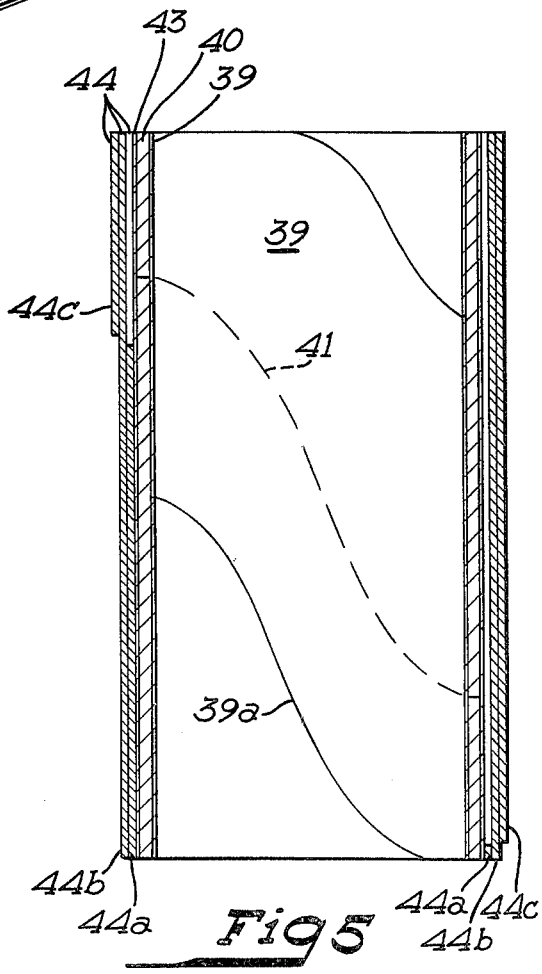
FIG. 5 is a longitudinal sectional view of the complete container before the ends are applied.
Figure 4:
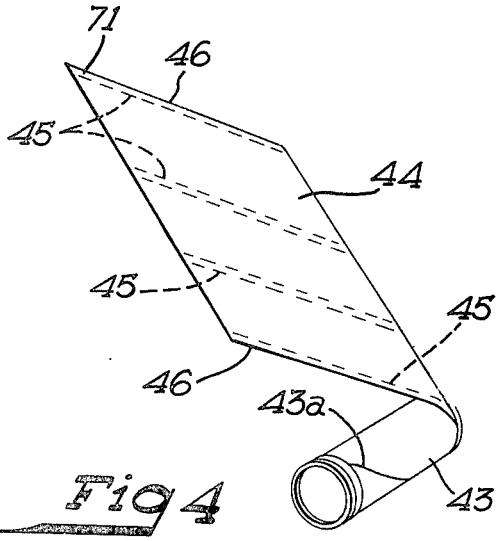
FIG. 4 is a view similar to FIG. 3, showing the label pulled further away from its adhesive connection with the outer wall.

Refer now to the figures and particularly the FIGS. 3, 4 and 5 which show a fiber container in accordance with the present invention. The container includes a fiber body stock layer 40 formed from a relatively heavy fiber strip or sheet having a helical separation line 41. Within the heavy body stock layer 40 is a liner 39 composed of for example, aluminum foil bonded to paper with the aluminum foil layer innermost and having a layer of lacquer on its inside surface. The edge of the liner are sealed together along a seam 39*a* (FIG. 5).

Over the body stock 40 is wound the temporary reinforcing sheet 43 composed of paper or the like which is bonded to the body stock on either side of separation line 41. The sheet 43 is formed from a strip of approximately the same width as the fiber body stock 40. The sheet 43 is also spirally wound but in overlapping relationship with respect to the separation line 41. Over this structure composed of the liner, body stock and the temporary reinforcing sheet is the label 44 which at least covers the outside surface of the can but which may overlap itself as much as 1½ to 2½ times or more. The overlap is made possible by establishing the width of the label stock 44 (the distance from *a* to *b* in FIG. 2) to be at least slightly greater than the width of the other strips making up the container and up to 2 times or more the width of the other strips of material making up the container, viz., the liner, body stock and reinforcing sheet.

In FIG. 5, the label 44 shown with a width of twice that of the body stock appears in cross section, its innermost convolution is designated 44*a*, an intermediate convolution is marked 44*b* and an outer convolution 44*c*. The net effect is to provide two complete wraps of the label material which function as a large display surface upon which directions, photographs, and other information can be printed.

The flat, circular metal closures or covers 70 are applied (seamed) to the can ends conventionally. A circumferentially extending collar cut 69 is provided at one end of the can only partially through the thickness of the can and at least through the thickness of the label and preferably also through sheet 43 to provide a tab 71 which can be used to lift and remove the label from the can when the can is to be used.

Figure 1:
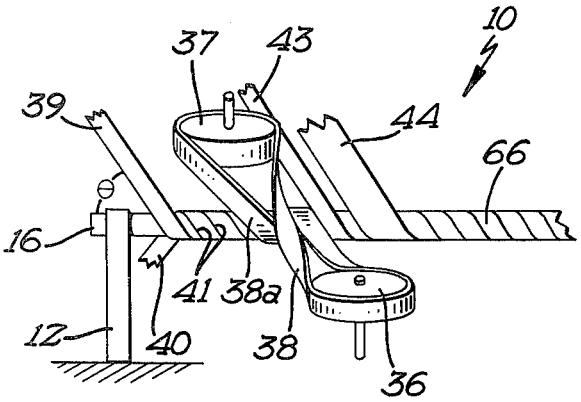
FIG. 1 is a side elevation of an apparatus for forming containers embodying the features of the invention.
Figure 2:
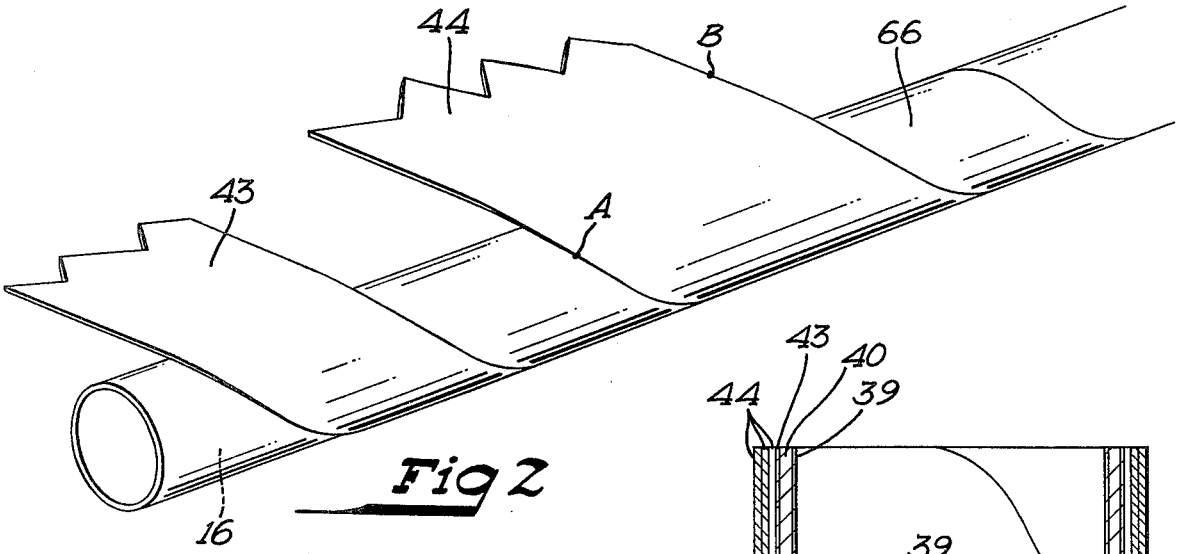
FIG. 2 is a perspective view showing the winding of the temporary reinforcing strip and outer label over the already formed liner and body stock.

The invention will be better understood by reference to FIGS. 1 and 2 which demonstrate a method for forming the container. As seen in the figure, the liner which consists of a sheet of relatively lightweight paper or a laminate of paper and aluminum foil 39 is helically wrapped upon a stationary cylindrical mandrel 16 supported at one end by a framework 12. The edges of the liner are slightly overlapped and bonded to themselves to form a seal at the edges thereof. Simultaneously, a strip 40 of the much heavier fiber body stock is continuously wrapped in spiral fashion upon the mandrel 16 in overlapping relationship with the liner 9 to define a helical butt joint or separation line 41 along its abutting edge.

It is known that for a given mandrel diameter and web width, only one winding angle, $\theta$, is possible if a butt joint 41 is to be maintained. The sheet 43 and the label 44 are applied at the same winding angle $\theta$ as the body stock 40 and liner 49, however, because of the much greater width of the label (distance $a - b$) the label overlaps itself substantially as described above. Minor differences in winding angle are permissible because as the winding angle $\theta$ becomes slightly less as the diameter of the tube increases and the diameter of the tube is of course increased slightly by addition of more webs.

Because the label can be as much as 2 or 3 times the width of the usual liner and body stock and is removably applied, the label can be used to provide large visual displays. The reinforcing sheet 43 can be used to provide additional printed material.

Referring again to FIG. 1, it can be seen that a pair of laterally displaced, horizontally disposed drive pulleys 36 and 37 mounted for rotation upon vertical axes are positioned on opposite sides of the mandrel 16 and are connected by means of a drive belt 38 to advance the convolutions formed on the mandrel 16. The belt 38 includes a portion 38*a* which is wrapped around the mandrel to drive the freshly formed spiral tube. To begin the forming operation, the liner and body stock sheets are fed into the winder upstream of the drive belt 38. The temporary reinforcing sheet 43 is fed onto the exterior of the tube thus formed downstream from the belt 38 as shown in FIG. 1 and the label 44 is simultaneously applied and helically wound in overlapping relationship with respect to the temporary reinforcing sheet 43 and in overlapping relationship with respect to the side edges of the underlying sheet 43. The strips are thus formed into a tube 66 as glue (not shown) is applied conventionally to strips 40 and 43 to secure them in position. As the label 44 is being wound onto the tube, it is necessary to provide enough adhesion between the label and the underlying material to assure traction and prevent slipping of the label either axially or circumferentially. This can be done by using a slightly tacky coating on either the outside surface of the sheet 43 or the inside surface of the label 44 or by applying heat, if the sheet is coated with a heat sensitive material, to one or both just before the label 44 is applied thereby temporarily rendering one or both surfaces tacky. This can be done with any of a number of available coating laquers such as ethyl cellulose or modified waxes applied to one or both of the surfaces to provide a temporary bonding adhesive layer which may be applied over the entire surface or as strips as shown at 45. While a variety of sticky coatings can be used such as coatings of soft waxes or fats including beeswax, microcrystaline wax and mixtures thereof with or without sticky resins such as Piccolyte resin or Piccopale resins. One suitable coating is a modified crystalline wax sold under the name Elvax Wax Blend, a modified microcrystaline wax which is available from the Champion Packaging Company of 150 26th Avenue Southeast, Minneapolis, Minn. An overlap adhesive may, if desired, be used to hold down the outermost free edge of the display label. As seen best in FIG. 3, one end of a portion of the label 44 adjacent to the collar cut 69 functions as a lifting tab 71 which enables the label 44 to be readily removed. A tear 73 forms along the opposite edge from the collar cut allowing the label 44 to be removed intact. The same collar cut 69 defines a lifting tab 43a in a portion of the temporary reinforcing sheet 43 adjacent to the collar cut to facilitate later removal of the reinforcing sheet. Thus, during use, the label 44 is removed first by pulling up on the tab 71. After it is completely removed and referred to by the user some later time, the container can be opened by removing the temporary reinforcing sheet 43 which is done as mentioned above by lifting the tab 43*a*. This will weaken the separation line 41 and allow the container to be opened by striking it against a solid object such as the edge of a table.

The tubes, once they have been completed on the winding and forming apparatus described in FIGS. 1 and 2, are cut to can length and are filled and capped conventionally. The invention is especially beneficial when the container must be opened quickly along its entire length as for example, the packaging of pressurized fresh dough for biscuits but should not be weakened to the point at which it may pop open prematurely by removal of the label.

What is claimed is:

1. A fiber can designed to permit easy, substantially full length opening thereof, said can comprising a generally cylindrical inner body strip having a weakened separation line extending helically substantially the full length thereof from one end of the can to the other, said inner body comprising a helically wound strip having its side edges abutting one another to define said weakened separation line and said strip having an established width, a temporary reinforcing means superimposed over abutting edges of the inner body and having at least a portion thereof overlying the separation line, said reinforcing means being readily removable from the underlying can body to expose the separation line throughout substantially the entire length thereof when the can is to be opened, an overlying label formed from flexible sheet material in strip form, said label having a width of at least about 1½ times the established width of the strip that forms the inner body, whereby the surface area of the label is at least about 1½ times the outside surface area of the sidewall of the can, end closures to seal the ends of the can and a circumferentially extending collar cut is provided on the exterior of the can to a depth extending at least through the label and reinforcing means to provide a lifting tab thereon to facilitate the separate removal of the label and reinforcing means whereby the label can be removed intact and the temporary reinforcing means can be removed at a later time to expose the weakened separation line.

2. The fiber can of claim 1 wherein the reinforcing means is helically wound upon the underlying sheet material at the same angle, in the same direction and in overlapping relationship with respect to the abutting edges of separation between the side edges of the body wall strip.

3. The can of claim 1 wherein a liner formed from sheet material is mounted within the cylindrical inner body strip.

4. The can of claim 1 wherein the temporary reinforcing means has substantially the same width as the inner body strip.

5. The fiber can of claim 1 wherein the reinforcing means comprises a strip of flexible sheet material wound helically upon the inner body strip and being glued thereto.

6. The fiber can of claim 1 wherein the label 44 is formed from sheet material, the width of the label being sufficient to allow the label to overlap itself about 1½ times to 2½ times and printed indicia is provided on the label.

7. The fiber container of claim 1 wherein a plurality of spaced apart strips of temporary bonding adhesive are provided between the label and the temporary reinforcing means to bond the label thereto.

8. The fiber can of claim 1 wherein the label comprises a flexible sheet having printed indicia thereon, the temporary reinforcing means comprises a reinforcing strip wound helically upon the inner body strip and a temporary bonding adhesive layer is present between the label and the reinforcing means to allow the label to be removed while the temporary reinforcing means remains in place.

9. The fiber can of claim 1 wherein a liner formed from flexible sheet material having overlapping edges bonded to themselves to form a seal at the edges thereof is provided upon the inside surface of the inner body strip.

10. The fiber can of claim 1 wherein the label comprises a flexible sheet having printed indicia thereon, the temporary reinforcing means comprises a reinforcing strip wound helically upon the inner body strip and a temporary bonding adhesive layer is present between the label and the reinforcing means to allow the label to be removed while the temporary reinforcing means remains in place, and a liner formed from flexible sheet material having overlapping edges bonded to themselves to form a seal at the edges thereof is provided upon the inside surface of the inner body strip.

* * * * *